US006367447B1

(12) United States Patent
Palansky et al.

(10) Patent No.: US 6,367,447 B1
(45) Date of Patent: Apr. 9, 2002

(54) ADJUSTMENT OF DRIVER DEMAND FOR ATMOSPHERIC CONDITIONS

(75) Inventors: Bruce John Palansky, Westland; Dennis Allen Light, Monroe; Michael John Cullen, Northville; Richard John Hippley, Canton, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/789,881

(22) Filed: Feb. 21, 2001

(51) Int. Cl.[7] ..... F02D 41/00

(52) U.S. Cl. ..... 123/361; 123/399; 123/435; 701/110

(58) Field of Search ..... 123/361, 395, 123/396, 399, 435; 701/110, 114; 180/197

(56) References Cited

U.S. PATENT DOCUMENTS 5,088,462 A 2/1992 Hertweck et al.
5,261,236 A 11/1993 Ironside et al.
5,421,302 A * 6/1995 Livshits et al. ..... 123/339.23
5,526,787 A 6/1996 Pallett
5,623,906 A 4/1997 Storhok
6,065,446 A * 5/2000 Engl et al. ..... 123/325
6,237,563 B1 * 5/2001 Froehlich et al. ..... 123/350
6,246,951 B1 * 6/2001 Robichaux et al. ..... 701/110

* cited by examiner

*Primary Examiner*—Terry M. Argenbright
*Assistant Examiner*—Hai Huynh
(74) *Attorney, Agent, or Firm*—Allan J. Lippa

(57) ABSTRACT

A system and method for controlling a multi-cylinder internal combustion engine include determining a currently available maximum torque, determining a driver demanded torque based on a current accelerator pedal position and reference ambient conditions, and controlling the engine to deliver the lesser of the driver demanded torque corresponding to the reference ambient conditions and a calibratable percentage of the currently available maximum torque corresponding to the current ambient conditions. A similar torque is provided at high altitudes as that provided at sea level for a given low pedal position while smoothly blending into the currently available peak torque.

25 Claims, 4 Drawing Sheets

ADJUSTMENT OF DRIVER DEMAND FOR ATMOSPHERIC CONDITIONS

BACKGROUND OF THE INVENTION

1. Field of the Invention

The present invention relates to a system and method for controlling a multi-cylinder internal combustion engine having electronically controlled airflow to provide a similar output torque characteristic under varying atmospheric conditions.

2. Background Art

Various engine control strategies have been developed to compensate for changes in available engine power or torque due to ambient conditions, such as temperature and barometric pressure. When driving a vehicle at high altitude, for example, conventional mechanical throttle control systems would seem sluggish or underpowered compared to sea level or lower altitudes across the entire range of accelerator pedal positions. This also created challenges in calibrating shift points for automatic transmissions, which were often based on accelerator pedal position, because the same pedal position resulted in a different output torque depending upon the ambient operating conditions.

SUMMARY OF THE INVENTION

An object of the present invention is to provide a system and method for controlling an engine which produces a smooth and continuous increase in wheel torque relative to accelerator pedal position at any altitude and ambient temperature while delivering the same torque for a given pedal position at all altitudes and ambient temperatures where sufficient torque is available.

In carrying out the above object and other objects, features, and advantages of the present invention, a system and method for controlling a multi-cylinder internal combustion engine include determining a currently available maximum torque, determining a driver demanded torque based on a current accelerator pedal position and reference ambient conditions, and controlling the engine to deliver the lesser of the driver demanded torque and a calibratable percentage of the currently available maximum torque.

The present invention provides a number of advantages. For example, the present invention provides a similar torque at high altitudes as at sea level for a given low pedal position while smoothly blending into the currently available peak torque. The greater torque available at high altitude for lower pedal positions is preferred by some drivers. In addition, the present invention provides a model based approach which requires less calibration effort and is more robust to intended consequences which may otherwise result from an approach requiring more complex calibrations.

The above advantages and other advantages, objects, and features of the present invention will be readily apparent from the following detailed description of the preferred embodiments when taken in connection with the accompanying drawings.

DETAILED DESCRIPTION OF THE PREFERRED EMBODIMENT(S)

As will be appreciated by those of ordinary skill in the art, the present invention is independent of the particular underlying engine technology and configuration. As such, the present invention may be used in a variety of types of internal combustion engines to provide similar torque at altitude as that provided at sea level for a corresponding accelerator pedal position. For example, the present invention may be used in conventional engines in addition to direct injection stratified charge (DISC) or direct injection spark ignition (DISI) engines which may use VCT or variable valve timing mechanisms in combination with or in place of an electronically controlled throttle valve to control airflow, for example.

Figure 1:
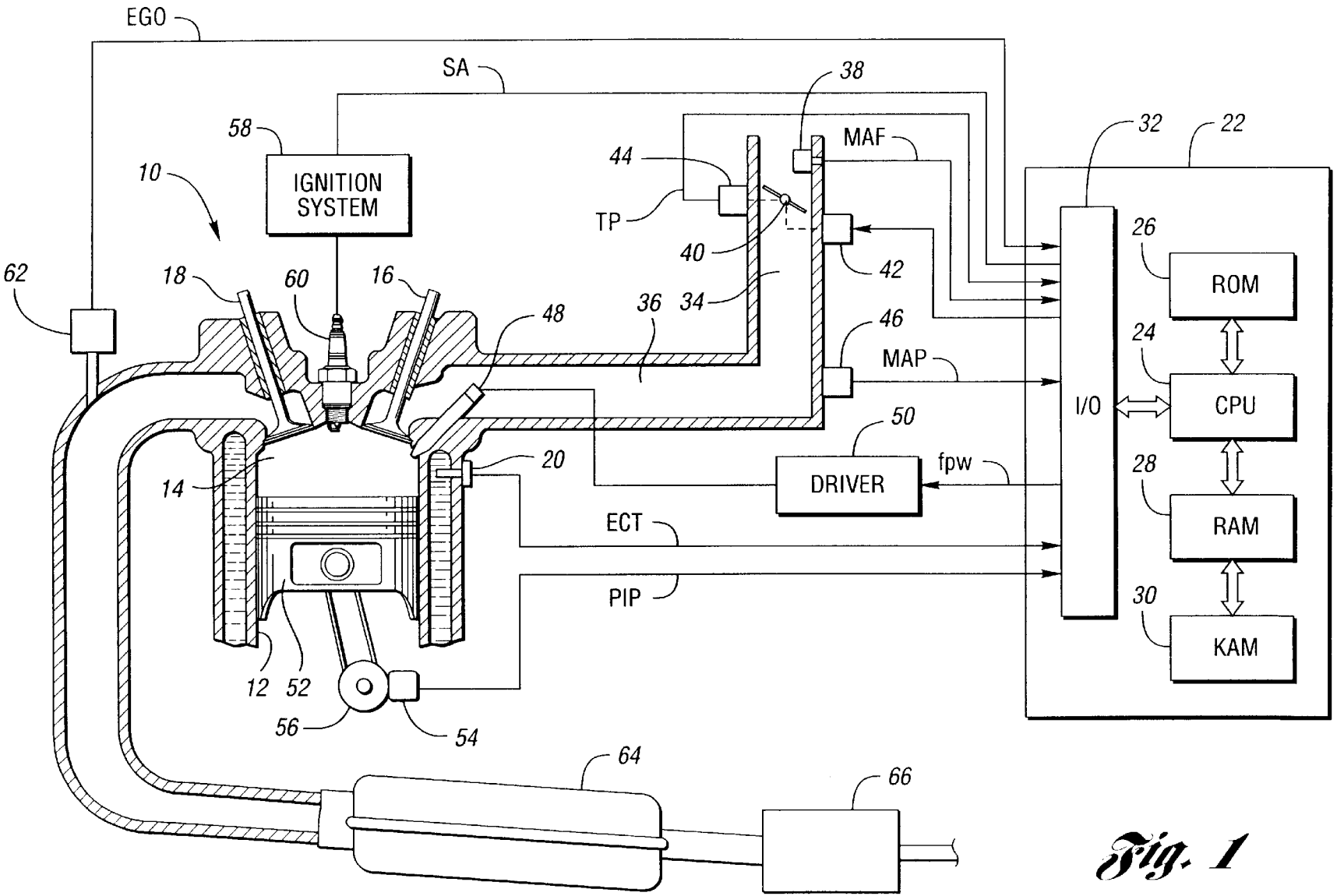
FIG. 1 is a block diagram illustrating operation of one embodiment of a system or method for controlling an engine according to the present invention.

A block diagram illustrating an engine control system and method for a representative internal combustion engine according to the present invention is shown in FIG. 1. System 10 preferably includes an internal combustion engine having a plurality of cylinders, represented by cylinder 12, having corresponding combustion chambers 14. As one of ordinary skill in the art will appreciate, system 10 includes various sensors and actuators to effect control of the engine. One or more sensors or actuators may be provided for each cylinder 12, or a single sensor or actuator may be provided for the engine. For example, each cylinder 12 may include four actuators which operate the intake valves 16 and exhaust valves 18, while only including a single engine coolant temperature sensor 20.

System 10 preferably includes a controller 22 having a microprocessor 24 in communication with various computer-readable storage media. The computer readable storage media preferably include volatile and nonvolatile storage in a read-only memory (ROM) 26, a random-access memory (RAM) 28, and a keep-alive memory (KAM) 30, for example. As known by those of ordinary skill in the art, KAM 30 may be used to store various operating variables while controller 22 is powered down but is connected to the vehicle battery (not shown). The computer-readable storage media may be implemented using any of a number of known memory devices such as PROMS, EPROMs, EEPROMS, flash memory, or any other electric, magnetic, optical, or combination memory device capable of storing data, some of which represent executable instructions, used by microprocessor 24 in controlling the engine. The computer-readable storage media may also include floppy disks, CD-ROMs, hard disks, and the like. Microprocessor 24 communicates with the various sensors and actuators via an input/output (I/O) interface 32. Of course, the present invention could utilize more than one physical controller, such as controller 22, to provide engine/vehicle control depending upon the particular application.

In operation, air passes through intake 34 where it may be distributed to the plurality of cylinders via an intake manifold, indicated generally by reference numeral 36. System 10 preferably includes a mass airflow sensor 38 which provides a corresponding signal (MAF) to controller 22 indicative of the mass airflow. Mass airflow sensor 38 may also include a temperature sensor to provide a corresponding signal (ACT) indicative of the air charge temperature. If no mass airflow sensor and/or temperature sensor is present, corresponding mass airflow values and air charge temperatures may be inferred from various other engine operating parameters. A throttle valve 40 may be used to modulate the airflow through intake 34 during certain operating modes. Where present, throttle valve 40 is preferably electronically controlled by an appropriate actuator 42 based on a corresponding throttle position signal generated by controller 22. A throttle position sensor 44 provides a feedback signal (TP) indicative of the actual position of throttle valve 40 to controller 22 to implement closed loop control of the position of throttle valve 40.

As illustrated in FIG. 1, a manifold absolute pressure sensor 46 may be used to provide a signal (MAP) indicative of the manifold pressure to controller 22. Air passing through intake manifold 36 enters combustion chamber 14 through appropriate control of one or more intake valves 16. Intake valves 16 and exhaust valves 18 may be controlled directly or indirectly by controller 22 for variable valve timing or variable cam timing applications, respectively. Alternatively, intake valves 16 and exhaust valves 18 may be controlled using a conventional camshaft arrangement. A fuel injector 48 injects an appropriate quantity of fuel in one or more injection events for the current operating mode based on a signal (FPW) generated by controller 22 processed by driver 50. Control of the fuel injection events is generally based on the position of piston 52 within cylinder 12. Position information is acquired by an appropriate sensor 54 which provides a position signal (PIP) indicative of rotational position of crankshaft 56. At the appropriate time during the combustion cycle, controller 22 generates a spark signal (SA) which is processed by ignition system 58 to control spark plug 60 and initiate combustion within chamber 14.

Controller 22 (or a conventional camshaft arrangement) controls one or more exhaust valves 18 to exhaust the combusted air/fuel mixture through an exhaust manifold. An exhaust gas oxygen sensor 62 provides a signal (EGO) indicative of the absolute or relative oxygen content of the exhaust gases to controller 22. This signal may be used to adjust the air/fuel ratio, or control the operating mode of one or more cylinders. The exhaust gas is passed through the exhaust manifold and through first and second emissions control devices 64 and 66, which may include a catalytic converter, for example, before being exhausted to atmosphere.

According to the present invention, controller 22 adjusts the driver demanded torque to provide a smooth and continuous increase in wheel torque relative to accelerator pedal position at any altitude and ambient temperature while delivering the same torque for a given accelerator pedal position at all altitudes and ambient temperatures where available by appropriate airflow control, as may be provided by an electronically controlled throttle, for example. The control strategy, preferably implemented primarily by controller 22 eliminates dead pedal feel at high pedal angles and high altitudes while preserving a higher "sea level" torque for the same pedal position if sufficient torque is available for current atmospheric conditions.

Figure 2:
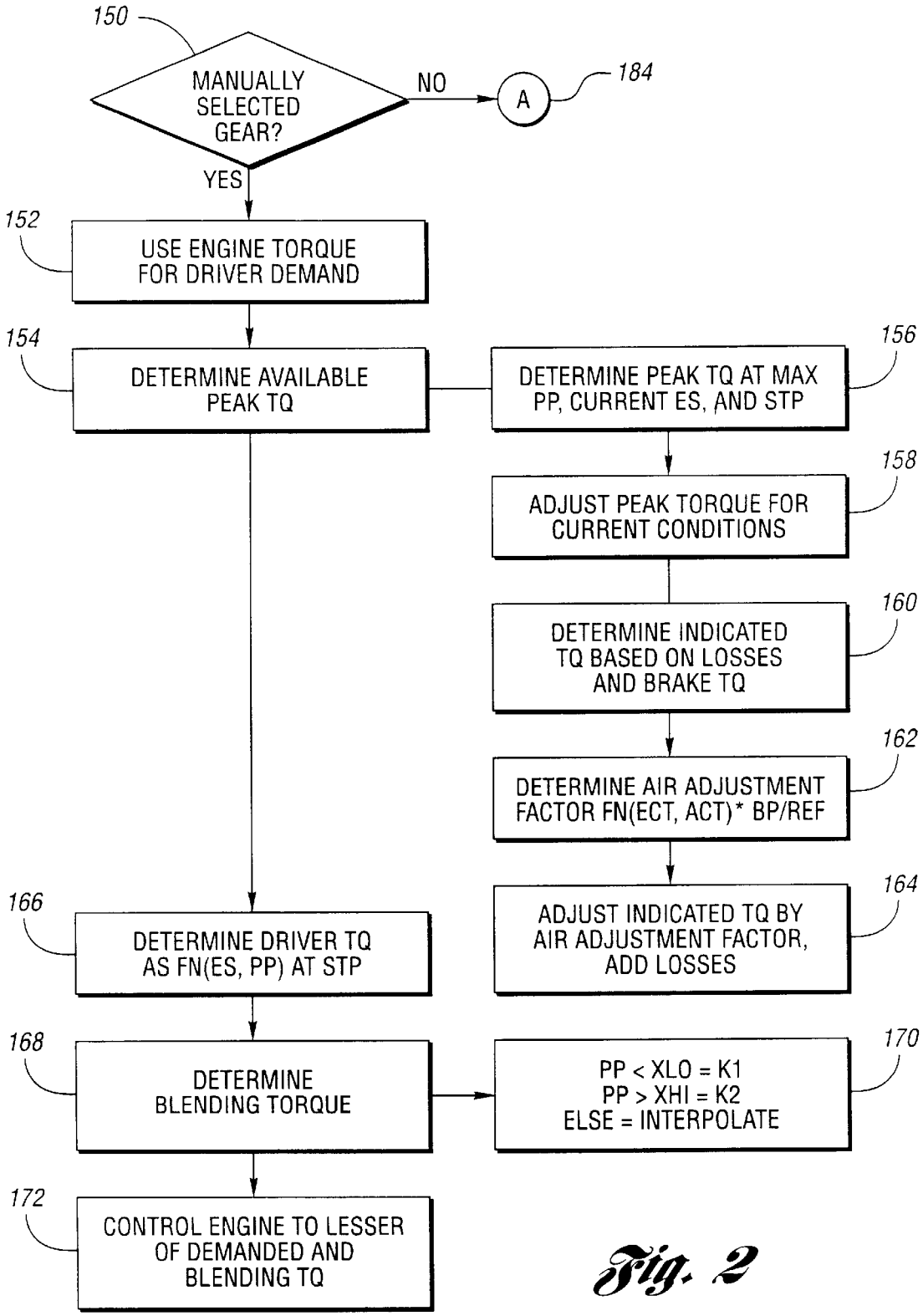
FIGS. 2 and 3 are flow diagrams illustrating operation of one embodiment for a system or method for controlling an engine according to the present invention.
Figure 3:
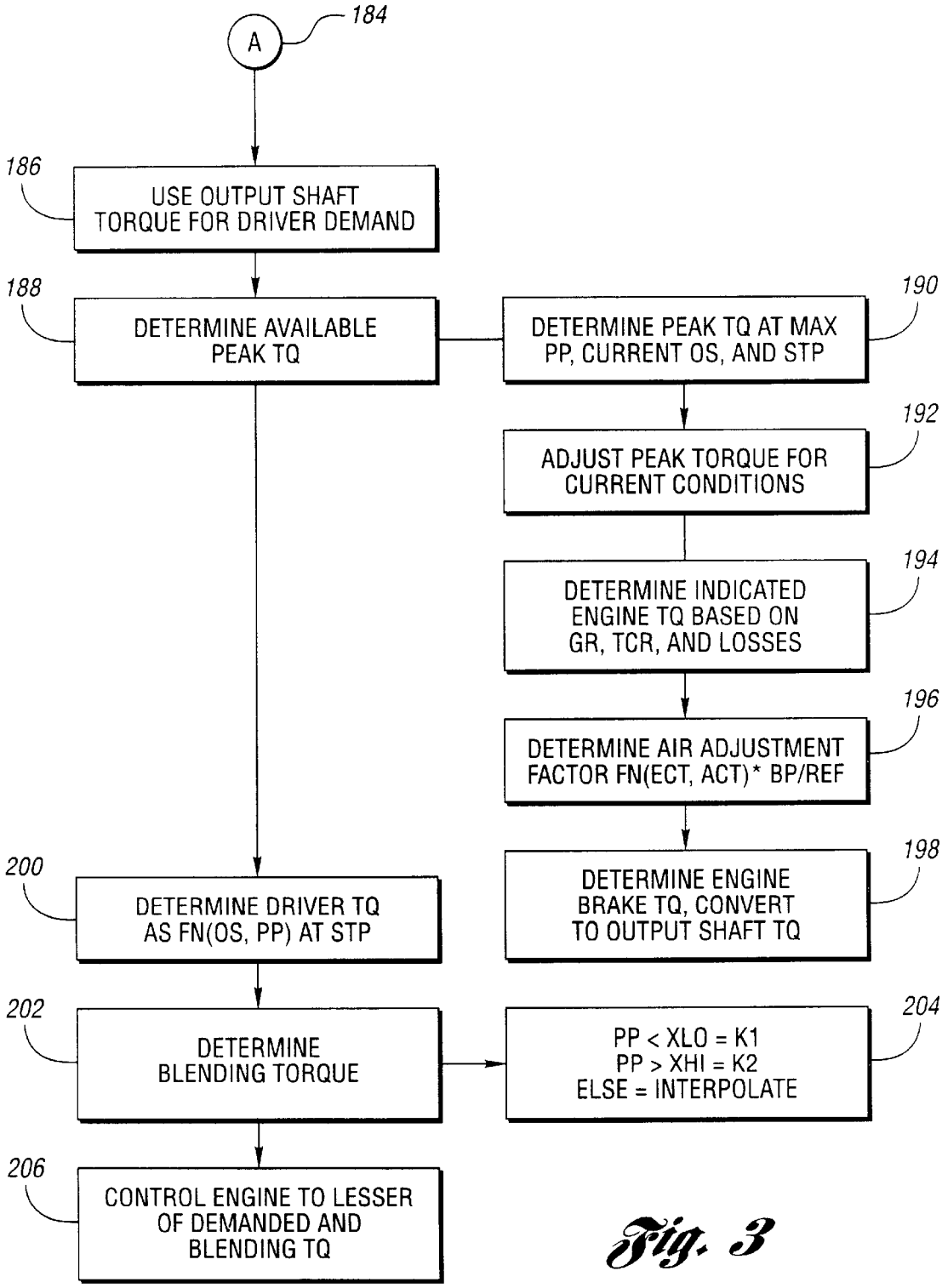

The diagrams of FIGS. 2 and 3 generally represent operation of one embodiment of a system or method according to the present invention. As will be appreciated by one of ordinary skill in the art, the diagrams may represent any one or more of a number of known processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages of the invention, but is provided for ease of illustration and description. Although not explicitly illustrated, one of ordinary skill in the art will recognize that one or more of the illustrated steps or functions may be repeatedly performed depending upon the particular processing strategy being used.

Preferably, systems or methods of the present invention are implemented primarily in software executed by a microprocessor-based engine controller. Of course, the control logic may be implemented in software, hardware, or a combination of software and hardware depending upon the particular application. When implemented in software, the control logic is preferably provided in a computer-readable storage medium having stored data representing instructions executed by a computer to control the engine. The computer-readable storage medium or media may be any of a number of known physical devices which utilize electric, magnetic, and/or optical devices to temporarily or persistently store executable instructions and associated calibration information, operating variables, and the like.

Referring now to FIG. 2, block 150 represents determination of whether a transmission gear has been manually selected. In one embodiment, a status flag is examined to determine whether a manual or automatic transmission is present for the vehicle. In addition, vehicles configured with automatic transmissions examine an operating parameter associated with the gear selected by the driver. If the vehicle is configured with a manual transmission or an automatic transmission with a manually selected gear (such as 3, 2, low, or the like but excluding drive or overdrive, for example) then the driver demand is calculated in units of desired engine torque as represented by block 152.

To calculate the driver demand in units of desired engine torque as represented by block 152, the currently available maximum or peak torque is determined as represented by block 154. Preferably, the currently available maximum or peak torque is based on current ambient conditions such as barometric pressure and temperature. As described in greater detail below, temperature may represent any of a number of operating parameters including air charge temperature (ACT), engine coolant temperature (ECT), and the like.

To determine the currently available peak torque as represented by block 154, a table lookup is performed using the maximum value for the accelerator pedal position (PP) and the current value for engine speed (ES). Preferably, the table includes calibratable values for desired engine torque corresponding to various accelerator pedal positions for reference ambient conditions, such as standard temperature and pressure (STP) conditions. In one embodiment, the reference conditions correspond to a barometric pressure of about 29.92 mmHg and an air charge temperature of about 100° F.

The maximum or peak torque value determined for STP as represented by block 156 is then adjusted for current ambient conditions as represented by block 158. In one embodiment, the peak demanded torque is adjusted for current barometric pressure and air charge temperature using an air adjustment factor as represented by blocks 160–164. The air adjustment factor generally represents the ratio of air mass at the current barometric pressure and air charge temperature conditions to the air mass flow at the reference conditions. The air adjustment factor generally applies to indicated torque in this implementation. As such, various losses are added to the brake torque (such as those due to friction and the like) to convert the brake torque to indicated torque prior to multiplying by the adjustment factor. These losses are then subtracted to again provide a desired brake torque as described in detail below.

Block 160 determines the indicated torque based on various torque losses and the previously determined brake torque by adding the losses to the brake torque as discussed above. Block 162 then determines an air adjustment factor which is preferably found in a calibration table indexed by engine coolant temperature (ECT) and air charge temperature (ACT) which is then multiplied by a ratio of the current barometric pressure (BP) relative to the reference value for barometric pressure, typically 29.92 mmHg. After adjusting the indicated torque by multiplying by the air adjustment factor, block 164 adds the torque losses to determine the currently available maximum brake torque represented by block 154.

Block 166 of FIG. 2 determines a driver demanded torque based on a current accelerator pedal position and reference ambient conditions. In the embodiment illustrated, the driver demanded torque is determined from a lookup table indexed by current engine speed (ES) and accelerator pedal position (PP) with the reference ambient conditions corresponding to a barometric pressure of 29.92 mmHg and an air charge temperature of 100° F. The blending torque is then determined as represented by block 168.

The blending torque provides a smooth and continuous torque increase between the driver demanded torque based on the reference ambient conditions and the currently available maximum torque based on current ambient conditions. In one embodiment, the blending torque is implemented by a function based on the current accelerator pedal position (PP) as represented by block 170. In this embodiment, the blending torque is a calibratable percentage (K1) of the currently available maximum torque for pedal positions below a first threshold (X low), a second calibratable percentage (K2) for accelerator pedal positions above a second threshold (X high), and is linearly interpolated between the thresholds. Representative values for a typical application are as follows:

X low=8

X high=20

K1=0.9 or 90%

K2=1.0 or 100%

The engine is controlled to deliver the lesser of the driver demanded torque corresponding to the reference ambient conditions and the calibratable percentage of the currently available maximum torque corresponding to the current ambient conditions as represented by block 172. As known by those of ordinary skill in the art, engine torque may be controlled by controlling fuel, airflow, and/or spark.

If block 150 of FIG. 2 determines that an automatic transmission is present and an automatic gear (such as drive or overdrive) has been selected, then processing continues as represented by block 184 and the flowchart of FIG. 3. In this case, the driver demand is preferably determined or calculated in units of output shaft torque as represented by block 186. The currently available maximum or peak torque is determined as represented by block 188. Preferably, the currently available peak torque is determined by first determining the peak torque available for reference ambient conditions corresponding to a maximum accelerator pedal position and the current output shaft speed (OS) as represented by block 190. This value is then adjusted for current ambient conditions such as barometric pressure and air charge temperature as represented by block 192. Preferably, the adjustment for current ambient conditions converts the output shaft torque to an indicated engine torque based on the current gear ratio (GR), torque converter ratio (TCR), and losses. Preferably, the losses are contained in a table which may be a function of engine speed, manifold absolute pressure, engine coolant temperature, and the operational state of various accessories as described in greater detail in U.S. Pat. No. 5,241,855, for example. Block 196 then determines an air adjustment factor from a lookup table based on engine coolant temperature (ECT) and air charge temperature (ACT) which is then multiplied by a ratio of the current barometric pressure relative to the reference barometric pressure. The losses are then added to the engine indicated torque to determine the engine brake torque which is then converted to an output shaft torque as represented by block 198.

After determining the currently available maximum torque as represented by block 188, the driver demanded torque is determined from a lookup table based on output shaft speed and accelerator pedal position at the reference ambient conditions as represented by block 200. A blending torque is then determined as represented by blocks 202 and 204 as described above with reference to block 168 and 170. The engine is then controlled to deliver the lesser of the driver demanded torque and blending torque as represented by block 206.

Figure 4:
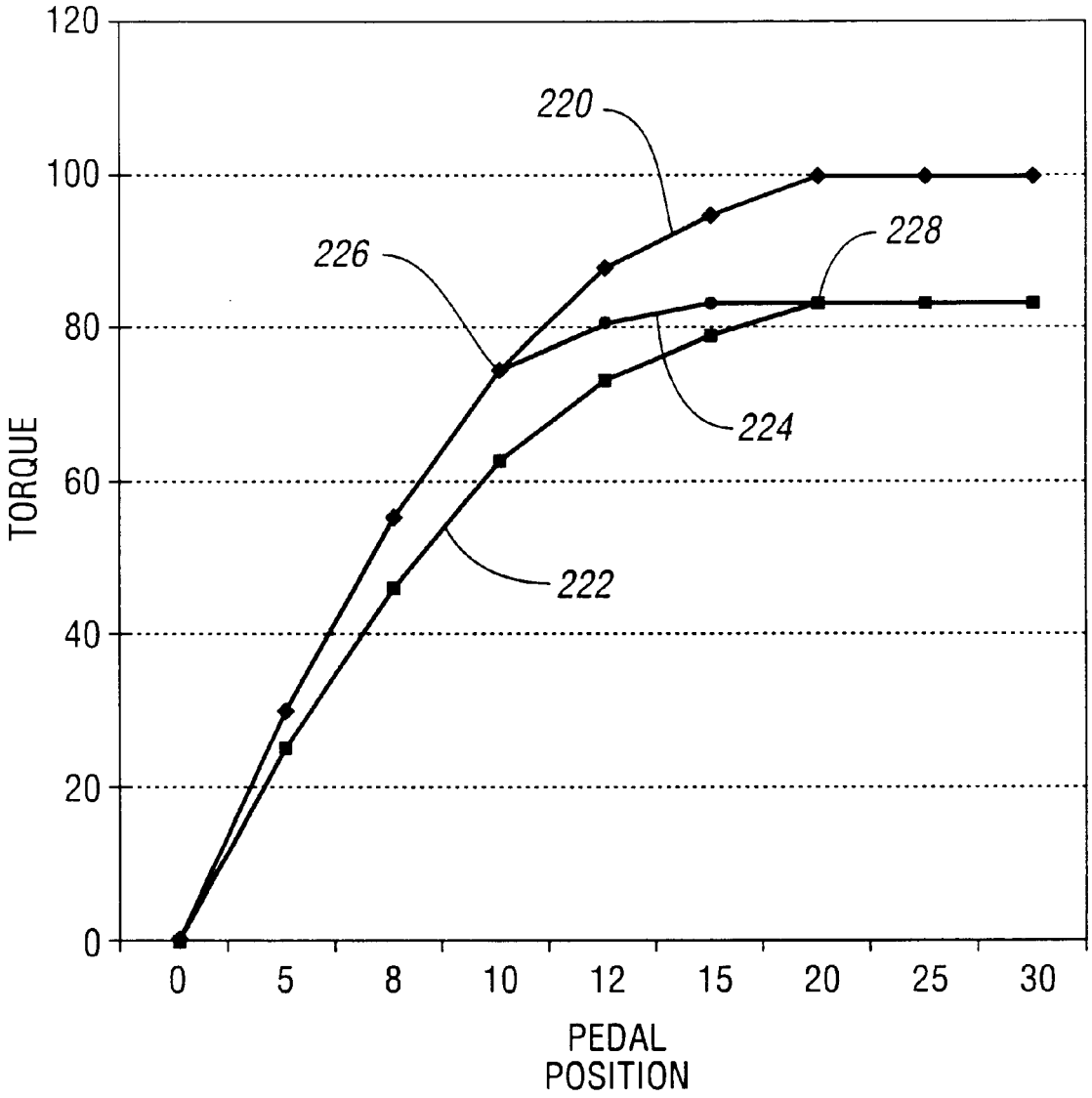
FIG. 4 is a graph illustrating operation of the present invention relative to some prior art approaches.

Referring now to FIG. 4, a graph illustrating operation of the present invention relative to prior art control strategies is shown. The graph illustrates the behavior of torque as a function of accelerator pedal position for a given engine speed. Line 220 represents the torque for reference ambient conditions, such as at sea level, for example. Line 222 represents a conventional system which does not have electronic airflow control operated at a lower barometric pressure such as would occur at higher altitudes. As illustrated by line 222, the torque provided at a lower barometric pressure for a given pedal position is less than that provided at the higher barometric pressure across the entire operating range. Line 224 represents operation of the present invention at the same barometric pressure as line 222 (corresponding to operation at higher altitudes). As illustrated by line 224, the present invention provides the same output torque as represented by line 220 over a large portion of the operating range. Between points 226 and 228, the torque is smoothly blended between the torque provided for the reference ambient conditions and the currently available maximum torque which is determined based on the current ambient conditions as described above. As such, the present invention delivers the same torque for a given pedal position at all altitudes and ambient temperatures where possible, i.e., up to point 226. In addition, the present invention provides a smooth and continuous increase in torque versus pedal position at any altitude and ambient temperature by blending or adjusting the torque between points 226 and 228.

While the best mode for carrying out the invention has been described in detail, those familiar with the art to which this invention relates will recognize various alternative designs and embodiments for practicing the invention as defined by the following claims.

What is claimed:

1. A method for controlling a multi-cylinder internal combustion engine having electronically controlled airflow, the method comprising:

determining a currently available maximum torque based on current ambient conditions;

determining a driver demanded torque based on a current accelerator pedal position and reference ambient conditions; and controlling the engine to deliver the lesser of the driver demanded torque corresponding to the reference ambient conditions and a calibratable percentage of the currently available maximum torque corresponding to the current ambient conditions.

2. The method of claim 1 wherein the step of determining a currently available maximum torque comprises:

determining demanded torque corresponding to current engine speed and a maximum accelerator pedal position; and adjusting the demanded torque based on current barometric pressure and a barometric pressure associated with the reference ambient conditions.

3. The method of claim 2 further comprising:

adjusting the demanded torque based on current engine coolant temperature and current engine air charge temperature.

4. The method of claim 1 wherein the step of determining a currently available maximum torque comprises:

determining a demanded brake torque corresponding to current engine speed and a maximum accelerator pedal position based on the reference ambient conditions;

adjusting the demanded brake torque based on frictional losses to determine a demanded indicated torque;

determining an air adjustment factor based on current engine coolant temperature, current air charge temperature, and current barometric pressure;

adjusting the demanded indicated torque based on the air adjustment factor; and adding the frictional losses to the adjusted demanded indicated torque to determine the currently available maximum torque.

5. The method of claim 1 wherein the reference ambient conditions correspond to sea level ambient conditions.

6. The method of claim 5 wherein the reference ambient conditions include a barometric pressure of about 29.9 mm Hg and an air charge temperature of about 100° F.

7. The method of claim 1 further comprising:

determining whether a transmission gear has been manually selected;

wherein the driver demanded torque and the maximum available torque represent an engine torque if a transmission gear has been manually selected and wherein the driver demanded torque and the maximum available torque represent an output shaft torque otherwise.

8. The method of claim 7 wherein the transmission gear is manually selected for an automatic transmission.

9. The method of claim 1 wherein an automatic transmission has drive or overdrive selected, and wherein the step of determining a currently available maximum torque comprises:

determining demanded output shaft torque corresponding to current output shaft speed and a maximum accelerator pedal position;

adjusting the demanded output shaft torque based on current barometric pressure, engine coolant temperature, and air charge temperature relative to barometric pressure, engine coolant temperature, and air charge temperature associated with the reference ambient conditions.

10. The method of claim 9 further comprising:

converting the demanded output shaft torque to a corresponding engine indicated torque prior to adjusting the demanded output shaft torque.

11. The method of claim 10 wherein the step of converting includes converting the demanded output shaft torque to a corresponding engine indicated torque based on a current gear ratio and current torque converter ratio.

12. The method of claim 1 wherein the calibratable percentage of the currently available maximum torque is based on the current accelerator pedal position.

13. The method of claim 12 wherein the calibratable percentage is constant if the accelerator pedal position is less than a first threshold or greater than a second threshold and varies linearly between the first and second thresholds.

14. The method of claim 13 wherein the calibratable percentage corresponds to a first constant value if the accelerator pedal position is less than the first threshold and a second constant value if the accelerator pedal position is greater than the second threshold.

15. A computer readable storage medium having stored data representing instructions executable by a computer to control a multi-cylinder internal combustion engine having electronically controlled airflow, the computer readable storage medium comprising:

instructions for determining a currently available maximum torque based on current ambient conditions;

instructions for determining a driver demanded torque based on a current accelerator pedal position and reference ambient conditions; and instructions for controlling the engine to deliver the lesser of the driver demanded torque corresponding to the reference ambient conditions and a calibratable percentage of the currently available maximum torque corresponding to the current ambient conditions.

16. The computer readable storage medium of claim 15 wherein the instructions for determining a currently available maximum torque comprise:

instructions for determining demanded torque corresponding to current engine speed and a maximum accelerator pedal position; and instructions for adjusting the demanded torque based on current barometric pressure and a barometric pressure associated with the reference ambient conditions.

17. The computer readable storage medium of claim 16 further comprising:

instructions for adjusting the demanded torque based on current engine coolant temperature and current engine air charge temperature.

18. The computer readable storage medium of claim 15 wherein the instructions for determining a currently available maximum torque comprise:

instructions for determining a demanded brake torque corresponding to current engine speed and a maximum accelerator pedal position based on the reference ambient conditions;

instructions for adjusting the demanded brake torque based on frictional losses to determine a demanded indicated torque;

instructions for determining an air adjustment factor based on current engine coolant temperature, current air charge temperature, and current barometric pressure;

instructions for adjusting the demanded indicated torque based on the air adjustment factor; and instructions for adding the frictional losses to the adjusted demanded indicated torque to determine the currently available maximum torque.

19. The computer readable storage medium of claim 15 further comprising:

instructions for determining whether a transmission gear has been manually selected;

wherein the driver demanded torque and the maximum available torque represent an engine torque if a transmission gear has been manually selected and wherein the driver demanded torque and the maximum available torque represent an output shaft torque otherwise.

20. A method for controlling a multi-cylinder internal combustion engine, the method comprising:

determining a peak desired torque based on a maximum accelerator pedal position and current engine speed;

adjusting the peak desired torque based on current barometric pressure and air charge temperature relative to a reference barometric pressure and air charge temperature;

determining a driver demanded torque based on a current accelerator pedal position and the reference barometric pressure and reference air charge temperature;

determining a blending torque based on the adjusted peak desired torque and the current accelerator pedal position; and controlling the engine to deliver the lesser of the driver demanded torque and the blending torque to provide a substantially similar torque at higher altitude relative to the reference barometric pressure and air charge temperature for low accelerator pedal positions.

21. A method for controlling a multi-cylinder internal combustion engine having electronically controlled airflow, the method comprising:

determining a currently available maximum torque based on current ambient conditions;

determining a driver demanded torque based on a current accelerator pedal position and reference ambient conditions; and controlling at least the airflow to deliver the lesser of the driver demanded torque corresponding to the reference ambient conditions and a calibratable percentage of the currently available maximum torque corresponding to the current ambient conditions.

22. The method of claim 21 wherein the calibratable percentage is constant if the accelerator pedal position is less than a first threshold or greater than a second threshold and varies linearly between the first and second thresholds.

23. The method of claim 21 wherein the calibratable percentage corresponds to a first constant value if the accelerator pedal position is less than the first threshold and a second constant value if the accelerator pedal position is greater than the second threshold.

24. The method of claim 21 wherein the step of controlling at least the airflow comprises controlling throttle valve position.

25. A method for controlling a multi-cylinder internal combustion engine having an electronically controlled throttle valve, the method comprising:

determining a currently available maximum torque based on current ambient conditions;

determining a driver demanded torque based on a current accelerator pedal position and reference ambient conditions;

controlling the throttle valve to modulate airflow to deliver the driver demanded torque corresponding to the reference ambient conditions if the accelerator pedal position is less than a first threshold; and controlling the throttle valve to modulate airflow to deliver a blending torque based on the reference ambient conditions and the current ambient conditions otherwise.

* * * * *